US007775744B1

(12) United States Patent
Lares

(10) Patent No.: US 7,775,744 B1
(45) Date of Patent: Aug. 17, 2010

(54) WEIGHTING BELT

(76) Inventor: Leonardo Lares, 10581 SW. 155th Pl., Miami, FL (US) 33196

( * ) Notice: Subject to any disclaimer, the term of this patent is extended or adjusted under 35 U.S.C. 154(b) by 0 days.

(21) Appl. No.: 11/925,032

(22) Filed: Oct. 26, 2007

(51) Int. Cl.
*B63C 11/30* (2006.01)

(52) U.S. Cl. ..... 405/186; 405/185

(58) Field of Classification Search ..... 405/185–187
See application file for complete search history.

(56) References Cited

U.S. PATENT DOCUMENTS 2,970,448 A * 2/1961 Di Julio ..... 405/186
3,470,570 A * 10/1969 Christiansen ..... 2/338
3,808,824 A * 5/1974 Johnston et al. ..... 405/186
4,455,718 A * 6/1984 Finnern ..... 405/186
4,789,270 A * 12/1988 Selisky ..... 405/186
2003/0113169 A1* 6/2003 Warlick ..... 405/185

* cited by examiner

*Primary Examiner*—Tara Mayo-Pinnock

(57) ABSTRACT

A weighting belt. An illustrative embodiment of the weighting belt comprises a belt strap and a plurality of weights provided on the belt strap. Each of the plurality of weights has a head portion, a pair of tapered side portions extending from the head portion and a tapered tail portion extending from the side portions.

6 Claims, 3 Drawing Sheets

WEIGHTING BELT

FIELD

The present invention relates to weighting belts. More particularly, the present invention relates to a weighting belt which is suitable for weighting underwater divers and is characterized by weights having minimal water resistance to enhance rates of descent.

BACKGROUND

Divers frequently require weighting belts which enable the divers to descend quickly to a desired depth in a water body. It is desirable for weighting belts to exert as little water resistance as possible to a diver as the diver descends in the water. It is also desirable for the diver to easily select the weight of the weighting belt.

Conventional weighting belts typically include multiple weights which are provided on a belt strap and are square or oval in shape. The number and positions of the weights on the belt strap must be adjusted prior to jumping of the diver into the water.

SUMMARY

The present invention is generally directed to a weighting belt. An illustrative embodiment of the weighting belt comprises a belt strap and a plurality of weights provided on the belt strap. Each of the plurality of weights has a head portion, a pair of tapered side portions extending from the head portion and a tapered tail portion extending from the side portions.

BRIEF DESCRIPTION OF THE DRAWINGS

The invention will now be described, by way of example, with reference to the accompanying drawings, in which.

DETAILED DESCRIPTION

Figure 1:
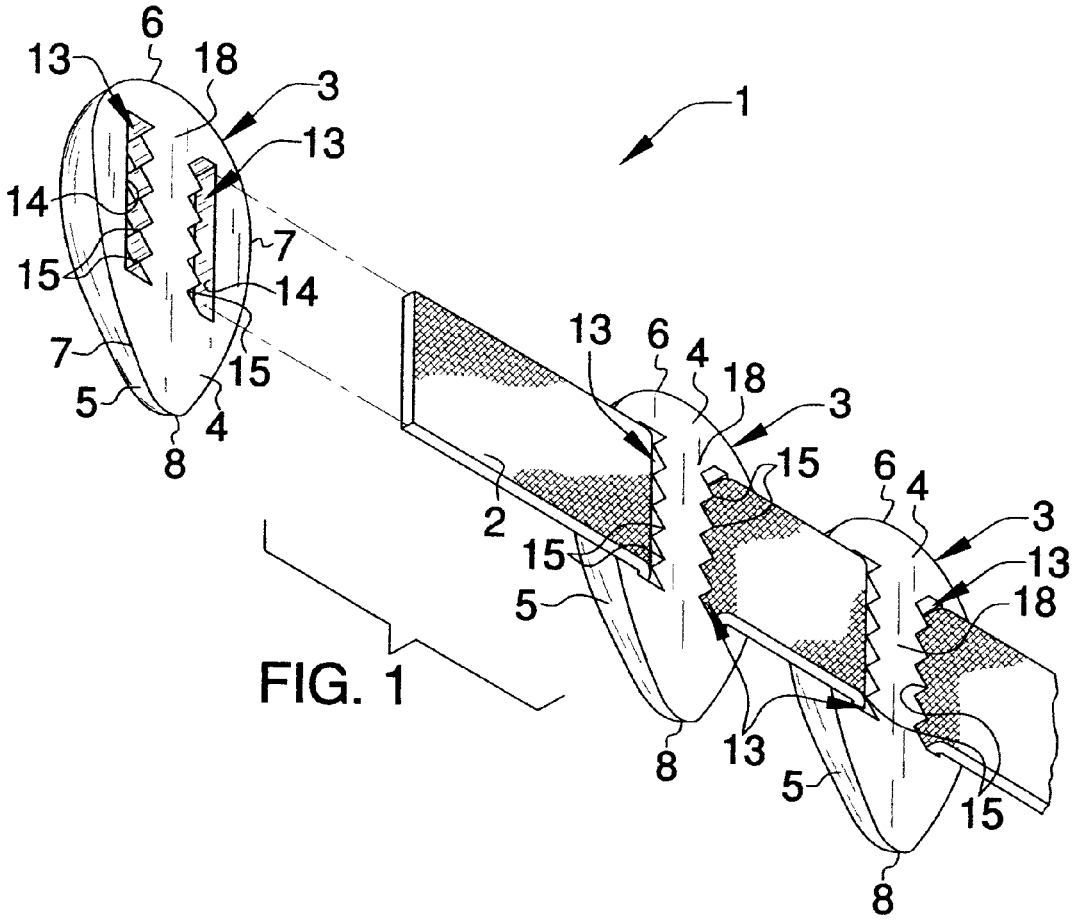
FIG. 1 is an exploded, perspective view, partially in section, of an illustrative embodiment of the weighting belt, more particularly illustrating an exemplary technique for attaching weights to a belt strap of the weighting belt.
Figure 2:
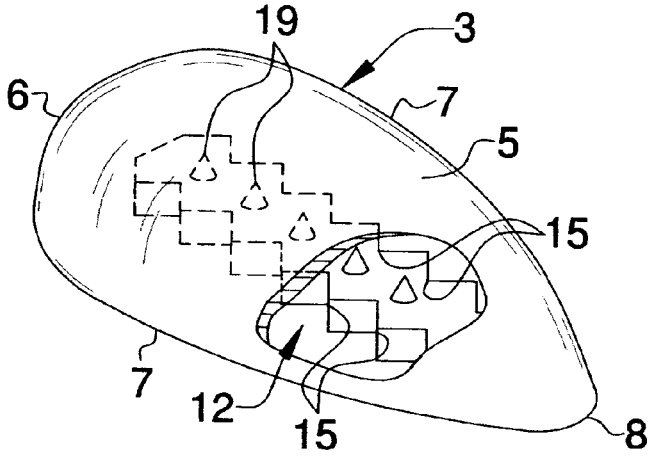
FIG. 2 is a front view, partially in section, of a weight element of an illustrative embodiment of the weighting belt.
Figure 3:
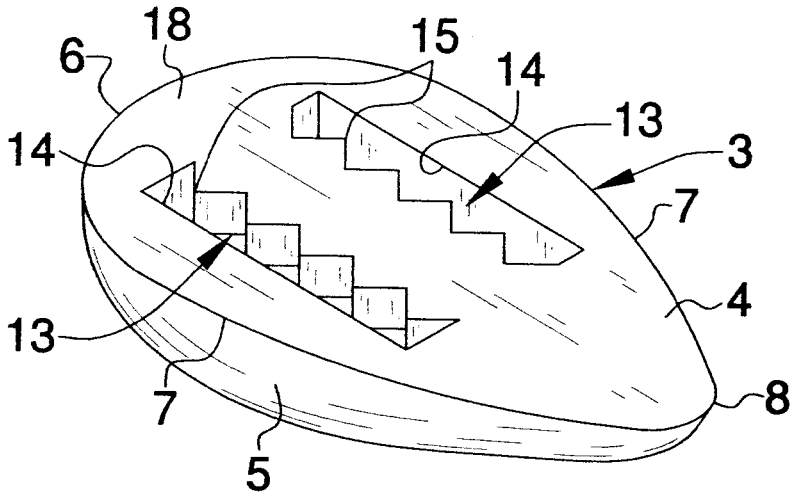
FIG. 3 is a rear perspective view of a weight element of an illustrative embodiment of the weighting belt.
Figure 4:
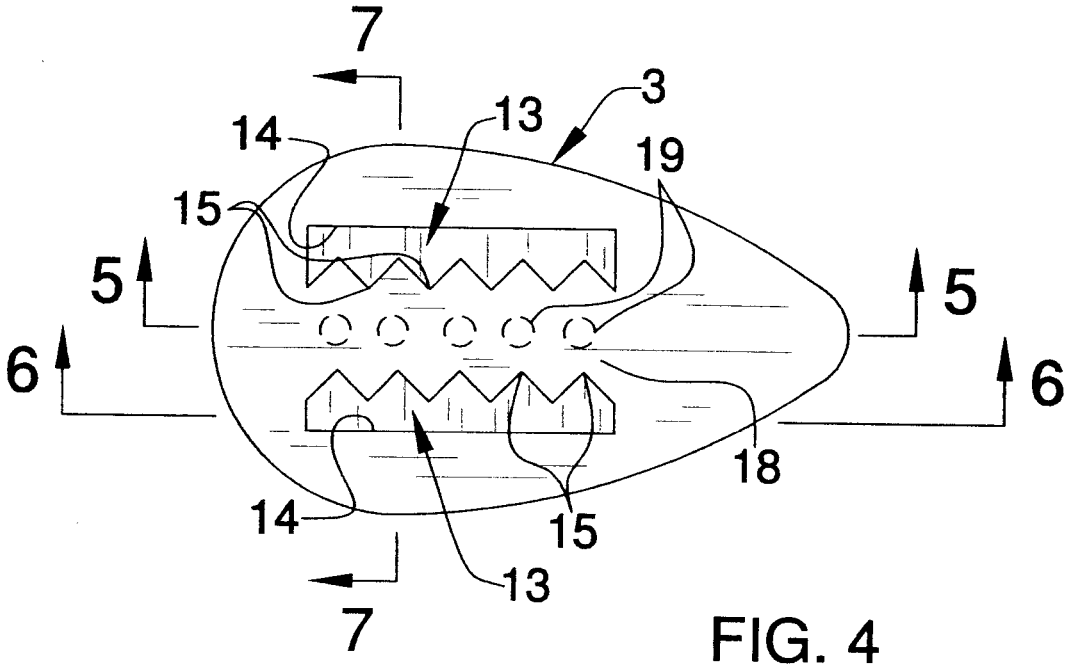
FIG. 4 is a rear view of an illustrative embodiment of the weighting belt.
Figure 5:
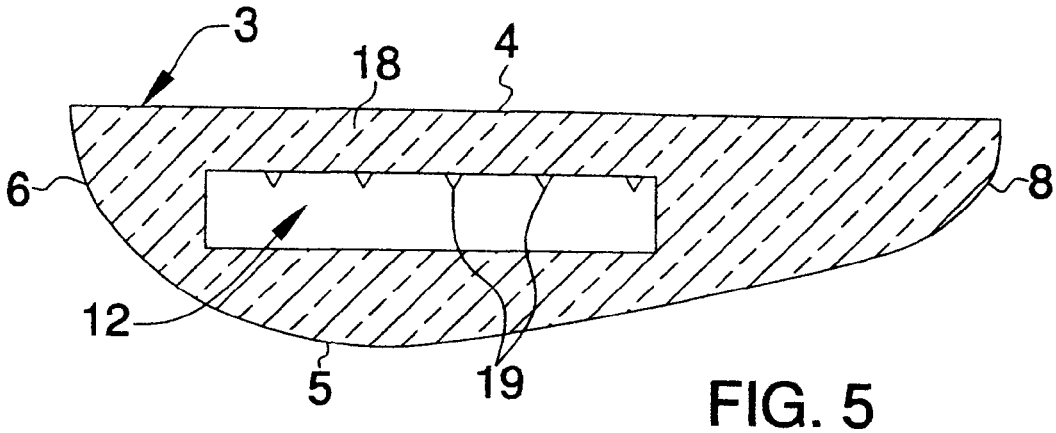
FIG. 5 is a sectional view, taken along section lines 5-5 in FIG. 4.
Figure 6:
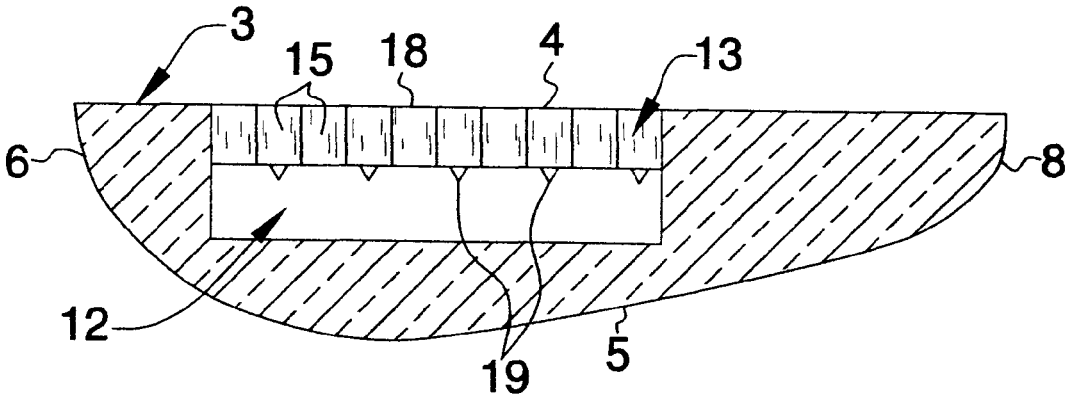
FIG. 6 is a sectional view, taken along section lines 6-6 in FIG. 4.
Figure 7:
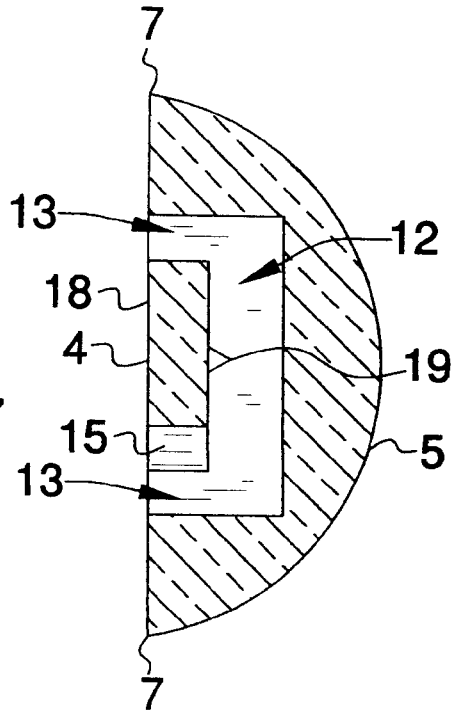
FIG. 7 is a sectional view, taken along section lines 7-7 in FIG. 4.

Referring to the drawings, an illustrative embodiment of the weighting belt is generally indicated by reference numeral 1 in FIG. 1. The weighting belt 1 includes an elongated, flexible belt strap 2 which may be nylon, for example. A buckle mechanism (not shown) is provided on the belt strap 2 to facilitate fastening of the belt strap 2 around the waist (not shown) of a user such as a diver, for example. A tightening mechanism (not shown) is typically further provided on the belt strap 2 to facilitate selective tightening of the belt strap 2.

Multiple weights 3 are provided on the belt strap 2. The weights 3 are detachably attached to the belt strap 2 typically in a manner which will be hereinafter described. Each weight 3 is typically lead and has a generally flat or planar belt-engaging surface 4 and a generally convex surface 5. Each weight 3 further has a teardrop shape and includes a head portion 6, a pair of tapered side portions 7 which extend from the head portion 6 and a tapered tail portion 8 which extends from the side portions 7 and is narrower than the head portion 6.

As shown in FIGS. 2 and 5-7, each weight 3 has a weight interior 12. A pair of spaced-apart strap slots 13, which may be generally elongated and parallel, is provided in the belt-engaging surface 4 and communicates with the weight interior 12. Each strap slot 13 has an outer straight edge 14 and an inner edge having multiple, adjacent slot teeth 15 which extend toward the straight edge 14. A generally elongated slot divider 18 separates the strap slots 15 from each other. As shown in FIGS. 2 and 4-7, in some embodiments at least one and typically multiple, spaced-apart slot divider teeth 19 extend from the slot divider 18, into the weight interior 12. The belt strap 2 and/or each of the weights 3 may be provided inside a cover (not shown) which prevents contact of the material of the belt strap 2 and/or each weight 3 with the ocean, preventing possible contamination of the ocean.

As shown in FIG. 1, in typical application the weighting belt 1 is donned by a diver (not shown) to weight the diver's body in a body of water (not shown). However, it is to be understood that the weighting belt 1 is amenable to alternative applications. Depending on the weight of the weighting belt 1 which is deemed necessary for the purpose, a selected number of weights 3 is provided on the belt strap 2. Accordingly, a strap end 2*a* of the belt strap 2 is inserted into the weight interior 12 (FIGS. 5-7) through one strap slot 13 and from the weight interior 12 through the other strap slot 13, after which the weight 3 is adjusted to a selected position along the length of the belt strap 2. The belt-engaging surface 4 of each weight 3 engages the outer surface of the belt strap 2, as further shown in FIG. 1. The slot teeth 15 in each strap slot 13, as well as the slot divider teeth 19 on the slot divider 18 in the weight interior 12, engage the belt strap 2 to prevent the weights 3 from inadvertently sliding along the belt strap 2.

The belt strap 2 of the weighting belt 1 is fastened and tightened around the waist (not shown) of the user (not shown), with the tail portion 8 of each weight 2 facing downwardly and the head portion 6 of each weight facing upwardly. Accordingly, as the diver descends in a water body, the weights 3 impart additional weight to the diver and expedite descent of the scuba diver in the water. It will be appreciated by those skilled in the art that the tapered shape of the tail portion 8 and the side portions 7 relative to the head portion 8 of each weight 2 minimizes the water resistance of each weight 2 in the water and facilitates equilibrium for rapid downward movement of the diver in the water as the diver descends in the water. The weights 3 can be removed from the belt strap 2 as desired to select the weight of the weighting belt 1 depending on the application of the weighting belt 1. In the event that the diver jumps into the water body when the weighting belt 1 is not properly adjusted on the diver, the diver will bend sideways; therefore, proper downward motion of the diver in the water requires that the weighting belt 1 be properly adjusted. The weighting belt 1 can be properly adjusted once the diver is immersed in the water body. The mass of each weight 3 is centered on the head portion 6 of the weight 3; therefore, the positions of the weights 3 on the belt strap 2 can be easily adjusted.

The present invention weighting belt also provides a rubber cover accessory which is ecologically friendly and minimizes contamination into the water (not shown).

While the preferred embodiments of the invention have been described above, it will be recognized and understood that various modifications can be made in the invention and the appended claims are intended to cover all such modifications which may fall within the spirit and scope of the invention.

What is claimed is:

1. A weighting belt for diving, comprising:

a belt strap suitable to be worn around the waist of a diver;

at least one weight member provided on said belt strap, wherein said at least one weight member has a generally convex tapered front face, a rear belt-engaging face, a head portion, a pair of tapered side portions extending from said head portion and a tapered tail portion extending from said side portions;

a weight interior provided between said front and rear faces of said at least one weight member;

a pair of spaced-apart strap slots provided in said at least one weight member and communicating with said weight interior;

a slot divider separating said strap slots; and at least one slot divider tooth extending from said slot divider into said weight interior; and wherein said weighting belt has minimal water resistance when worn by a diver during ascent or descent.

2. The weighting belt of claim 1 wherein each said strap slot is generally elongated.

3. The weighting belt of claim 2 wherein each said strap slot comprises a straight edge and a plurality of adjacent slot teeth extending into said each strap slot toward said straight edge.

4. The weighting belt of claim 1 wherein said plurality of weights comprises lead.

5. The weighting belt of claim 1 wherein said at least one weight member is substantially teardrop shaped.

6. The weighting belt of claim 1, further including a water-resistant cover for said belt, said at least one weight member or both.

* * * * *